US011054201B2

(12) United States Patent
Fazer

(10) Patent No.: US 11,054,201 B2
(45) Date of Patent: Jul. 6, 2021

(54) MAGAZINE FOR A FIREARM

(71) Applicant: Oy Asenetti Finland Ab, Helsinki (FI)

(72) Inventor: Joachim Fazer, Helsinki (FI)

(73) Assignee: OY ASENETTI FINLAND AB, Helsinki (FI)

( * ) Notice: Subject to any disclaimer, the term of this patent is extended or adjusted under 35 U.S.C. 154(b) by 0 days.

(21) Appl. No.: 16/623,482

(22) PCT Filed: Jul. 6, 2018

(86) PCT No.: PCT/FI2018/050536
§ 371 (c)(1),
(2) Date: Dec. 17, 2019

(87) PCT Pub. No.: WO2019/008234
PCT Pub. Date: Jan. 10, 2019

(65) Prior Publication Data

US 2020/0173745 A1 Jun. 4, 2020

(30) Foreign Application Priority Data

Jul. 7, 2017 (FI) ..... 20175664

(51) Int. Cl.
*F41A 9/70* (2006.01)
*F41A 9/65* (2006.01)
*F41A 9/58* (2006.01)

(52) U.S. Cl.
CPC . *F41A 9/70* (2013.01); *F41A 9/58* (2013.01)

(58) Field of Classification Search
CPC ..... F41A 9/00; F41A 9/24; F41A 9/25; F41A 9/61; F41A 9/64; F41A 9/65; F41A 9/67; F41A 9/70
See application file for complete search history.

(56) References Cited

U.S. PATENT DOCUMENTS 1,645,031 A * 10/1927 Von Frommer ..... F41A 9/67 42/50
3,110,122 A 11/1963 Musgrave
(Continued)

FOREIGN PATENT DOCUMENTS

WO 2016065184 A1 4/2016

OTHER PUBLICATIONS

ISA/FI, PCT International Search Report and Written Opinion dated Oct. 17, 2018 issued in PCT International Application No. PCT/FI2018/050536, filed Jul. 6, 2018.
(Continued)

*Primary Examiner* — Derrick R Morgan
(74) *Attorney, Agent, or Firm* — Robert P. Michal, Esq.; Carter, DeLuca & Farrell LLP

(57) ABSTRACT

The invention relates to a magazine for a firearm. The magazine comprises a hollow housing for retaining a plurality of cartridges and a follower arranged inside the hollow housing. The hollow housing has a first side wall, a second side wall opposing the first side wall and a feed opening for feeding the cartridges into the firearm. The first side wall has an outer first side wall surface and an inner first side wall surface and the second side wall has an outer second side wall surface and an inner second side wall surface such that an interior space of the hollow housing is provided between the inner first side wall surface and the inner second side wall surface. The magazine further comprises a stopping member for preventing the follower from escaping out from the hollow housing. The stopping member is arranged to protrude from the inner first side wall surface toward the interior space of the hollow housing.

20 Claims, 8 Drawing Sheets

(56) References Cited

U.S. PATENT DOCUMENTS

| | | | | | |
|---|---|---|---|---|---|
| 3,373,521 | A * | 3/1968 | Into | F41A 9/65 | 42/50 |
| 3,395,479 | A * | 8/1968 | Collins | F41A 9/70 | 42/50 |
| 4,314,419 | A * | 2/1982 | Koon, Jr. | F41A 9/65 | 42/50 |
| 4,502,237 | A * | 3/1985 | Krogh | F41A 9/70 | 42/50 |
| 4,888,899 | A * | 12/1989 | Chesnut | F41A 9/70 | 42/50 |
| 5,507,110 | A * | 4/1996 | Chesnut | F41A 9/65 | 42/50 |
| 8,166,692 | B2 * | 5/2012 | Fitzpatrick | F41A 9/70 | 42/50 |
| 8,726,561 | B1 | 5/2014 | Hampton | | |
| D745,945 | S * | 12/2015 | Kielsmeier | D22/108 | |
| 9,255,749 | B2 * | 2/2016 | Faifer | F16F 1/04 | |
| 9,383,152 | B2 * | 7/2016 | Nakayama | F41A 9/65 | |
| 9,506,707 | B2 * | 11/2016 | Nakayama | F41A 9/65 | |
| 10,480,879 | B2 * | 11/2019 | Harris | F41A 9/59 | |
| 2004/0020092 | A1 * | 2/2004 | Christensen | F41A 9/61 | 42/49.01 |
| 2011/0005113 | A1 * | 1/2011 | Fitzpatrick | F41A 9/65 | 42/1.02 |
| 2013/0086834 | A1 | 4/2013 | Battaglia | | |
| 2013/0247437 | A1 * | 9/2013 | Obermeit | F41A 9/69 | 42/49.01 |
| 2014/0075810 | A1 * | 3/2014 | Mikroulis | F41A 17/36 | 42/50 |
| 2015/0121736 | A1 * | 5/2015 | Faifer | F16F 1/04 | 42/49.01 |
| 2015/0292826 | A1 * | 10/2015 | Kielsmeier | F41A 9/70 | 42/50 |
| 2015/0345882 | A1 * | 12/2015 | Nakayama | F41A 9/70 | 42/50 |
| 2016/0025436 | A1 * | 1/2016 | Higley | F41A 9/65 | 42/49.01 |
| 2016/0116239 | A1 * | 4/2016 | Nakayama | F41A 9/70 | 42/50 |
| 2016/0327353 | A1 * | 11/2016 | DiChario | F41A 9/62 | |
| 2016/0348992 | A1 * | 12/2016 | Tisone | F41A 9/70 | |
| 2018/0142981 | A1 * | 5/2018 | Collazo | F41A 21/36 | |
| 2018/0172378 | A1 * | 6/2018 | Underwood | F41A 9/83 | |
| 2019/0049205 | A1 * | 2/2019 | Harris | F41A 3/66 | |
| 2019/0257605 | A1 * | 8/2019 | Chen | F41A 9/62 | |
| 2020/0103188 | A1 * | 4/2020 | Jen | F41A 9/66 | |

OTHER PUBLICATIONS

Finnish Patent and Registration Office, Search Report dated Jan. 29, 2018 issued in Finnish Patent Application No. 20175664 filed Jul. 7, 2017.

* cited by examiner

MAGAZINE FOR A FIREARM

CROSS-REFERENCE TO RELATED APPLICATIONS

This application is the United States National Stage entry under 35 U.S.C. 371 of PCT/FI2018/050536, filed Jul. 6, 2018, which in turn claims the priority of Finnish Patent Application No. 20175664, filed Jul. 7, 2017, the contents of each of which are hereby incorporated by reference in their entirety.

FIELD OF THE INVENTION

The present invention relates to a magazine for feeding cartridges into a firearm, and more particularly to a magazine for a firearm as defined in the preamble of the independent claim 1.

BACKGROUND OF THE INVENTION

Magazines generally comprise a body that has a feed end and a bottom end that is opposite to the feed end. The feed end has an opening for feeding the cartridges into a firearm and the bottom end closes the body for keeping the cartridges inside the body. The feed end is typically provided with feed lips to interface with the firearm and to guide the cartridges into the firearm. The magazine further comprises a follower which contacts the lowermost cartridge in the stack of cartridges inside the magazine and pushes it together with the stack above the lowermost cartridge upward toward the feed lips. After the last cartridge is shot the follower rests against the feed lips.

Typically, the body of magazines can be divided into two halves such that the follower together with a spring can be taken out from the body and the magazine can be cleaned. The two halves are connected together with small screws. In another typical prior art magazine, the bottom end is openable such that the follower and the spring can be taken out through the bottom end and then the magazine can be cleaned from inside.

One of the problems associated with the prior art is that when the magazine body is divided into two halves the screws have to be opened and then put back again after cleaning. The screws are small and the halves of the body have to be placed precisely together which requires carefulness from the user so that screws are not lost and the halves are not placed wrongly. The same preciseness is required when the bottom end is openable in order to get the follower out from the magazine body.

BRIEF DESCRIPTION OF THE INVENTION

An object of the present invention is to provide a magazine that alleviates the problems associated with the prior art magazines and especially problems that relate to removing the follower from the magazine so that the interior of the magazine can be reached for example because of cleaning the magazine. The objects of the invention are achieved by a magazine for a firearm which is characterized by what is stated in the independent claim. The preferred embodiments of the invention are disclosed in the dependent claims.

The invention is based on the idea of providing a magazine for a firearm, which comprises a hollow housing for retaining a plurality of cartridges and a follower arranged inside the hollow housing. The hollow housing comprises a first side wall, a second side wall opposing the first side wall and a feed opening for feeding the cartridges into the firearm. The first side wall comprises an outer first side wall surface and an inner first side wall surface and the second side wall comprises an outer second side wall surface and an inner second side wall surface such that an interior space of the hollow housing is provided between the inner first side wall surface and the inner second side wall surface. The magazine further comprises a stopping member for preventing the follower from escaping out from the hollow housing. The stopping member is arranged to protrude from the inner first side wall surface toward the interior space of the hollow housing. In other words, the stopping member is formed as a protrusion protruding from the inner first side wall surface toward the interior space of the hollow housing. The stopping member comprises a stopping surface for contacting the follower and the stopping member is arranged to the inner first side wall surface such that the stopping surface is at a first distance from the first upper end. The stopping surface is part of the stopping member formed as a protrusion.

The hollow housing is formed of the first side wall and the opposing second side wall, a rear wall and a front wall opposing the rear wall, and a base enclosing the hollow housing in a lower end of the hollow housing. The first side wall, the second side wall, the rear wall and the front wall are joining in the base and defining together an interior space of the hollow housing for retaining cartridges. The base is preferably arranged to be non-openable so that the follower cannot be removed through the base. In some other embodiments it may also be openable. The hollow housing has a feed opening opposing the base in an upper end of the hollow housing. In other words, the base is opposite to the feed opening.

The magazine further comprises a spring in connection with the follower such that the spring is arranged to extend between the follower and the base of the hollow housing for pushing the follower upward in the hollow housing. Upward meaning a direction from the base toward the feed opening. The spring is arranged inside the hollow housing in the interior space and in contact with the base of the hollow housing and the follower. The spring is arranged between the base and the follower such that the spring pushes the follower upward in the hollow housing. The spring is in contact with a bottom surface of the follower.

The follower comprises a top surface for supporting a cartridge, a first side surface facing toward the inner first side wall surface of the hollow housing and a second side surface facing toward the inner second side wall surface of the hollow housing. The follower further comprises a projection for forming a contact point with the stopping member. The stopping member comprises a stopping surface such that the projection of the follower is arranged to make contact with the stopping surface after the last cartridge is not resting on the top surface of the follower. In other words, the projection of the follower is arranged to rest against the stopping member when the top surface of the follower is empty, i.e. without any cartridge.

An advantage of the invention is that the follower can be removed from the hollow housing more easily than in the prior art magazines by releasing the follower from a contact with the stopping member by pushing a projection in the follower and releasing the follower upward in the hollow housing. The feed lips of the magazine are arranged to extend only partly around a feed opening of the hollow housing which allows the user to manipulate for example by pushing and tilting the follower so that it can be removed through the feed opening without disassembling the hollow housing into two halves or without removing the base of the hollow housing.

BRIEF DESCRIPTION OF THE DRAWINGS

The invention is described in detail by means of specific embodiments with reference to the enclosed drawings, in which.

DETAILED DESCRIPTION OF THE INVENTION

Figures 1A, 1B, 1C:
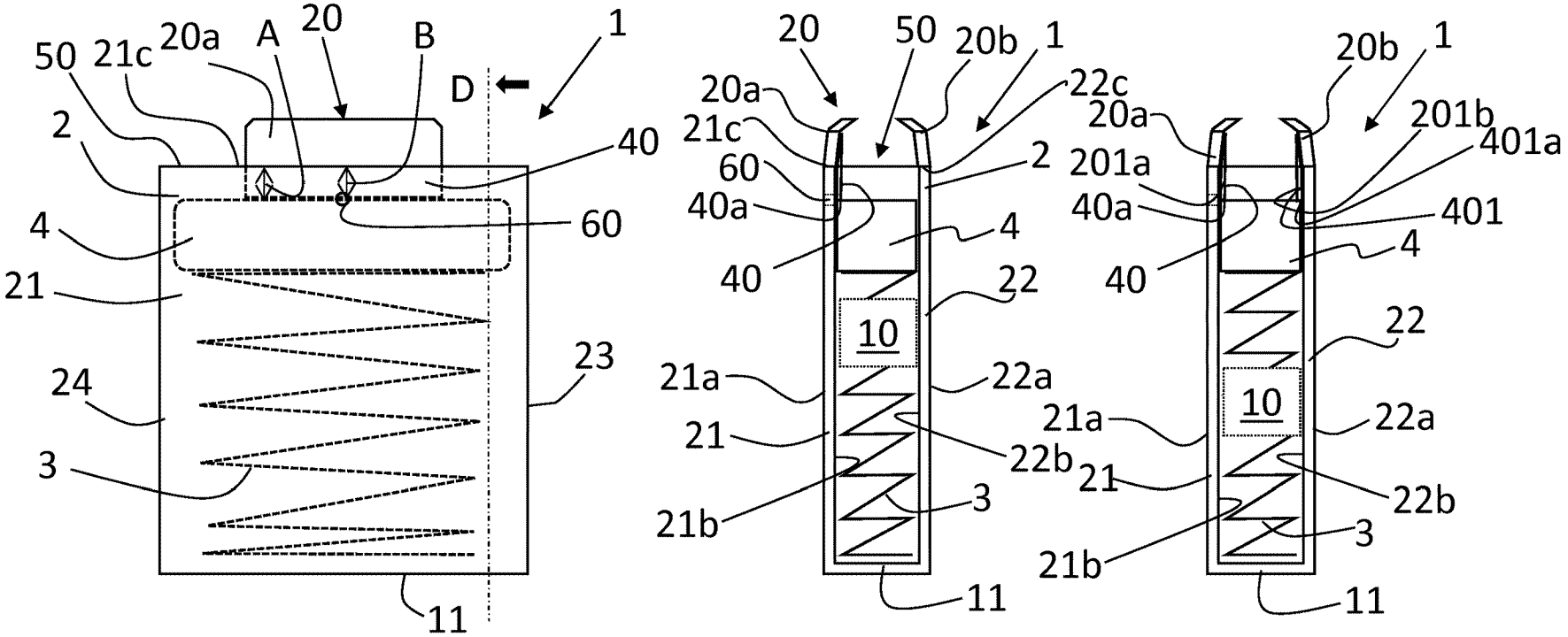
FIG. 1*a* shows a magazine according to the invention.
FIG. 1*b* shows a cross-section of a magazine along the line D shown in FIG. 1*a;*
FIG. 1*c* shows a cross-section of another embodiment of a magazine along the line D shown in FIG. 1*a;*

FIG. 1*a* shows a magazine 1 according to the invention as seen from outside such that the inner parts are shown with dashed lines. The magazine 1 comprises a hollow housing 2 for retaining a plurality of cartridges and a follower 4 arranged inside the hollow housing 2. The hollow housing 2 has a first side wall 21 and a second side wall 22 (not seen in FIG. 1*a*) opposing the first side wall 21. A feed opening 50 is arranged on the upper part of the hollow housing 2 for feeding the cartridges into the firearm. The feed opening 50 is for loading the magazine 1 with cartridges and for feeding the cartridges into the firearm. The first side wall 21 of the hollow housing 2 comprises a first upper end 21*c* and the second side wall 22 of the hollow housing 2 comprises a second upper end 22*c*. The first upper end 21*c* and the second upper end 22*c* form together the feed opening 50 of the hollow housing 2.

In other words, the hollow housing 2 is formed of the first side wall 21 and the opposing second side wall 22, a rear wall 23 and a front wall 24 opposing the rear wall 23, and a base 11 enclosing the hollow housing in a lower end of the hollow housing 2. The first side wall 21, the second side wall 22, the rear wall 23 and the front wall 24 are joining in the base 11 and defining together an interior space 10 of the hollow housing 2 for retaining cartridges. The hollow housing 2 comprises a feed opening 50 opposing the base 11 in an upper end of the hollow housing 2. In other words, the base 11 is opposite to the feed opening 50. The feed opening 50 is formed of the first upper end 21*c* of the first side wall 21 and the second upper end 22*c* of the second side wall 22 and the rear upper end of the rear wall 23 and the front upper end of the front wall 24. The front wall 24 and the rear wall 23 may comprise inner magazine structures such that the front wall 24 comprises front wall structures and the rear wall comprises rear wall structures. The front wall structures and the rear wall structures may be for example connecting structures for connecting together halves of the hollow housing 2. The hollow housing 2 can therefore be formed from two halves by connecting the halves together with screws or pins, or by gluing, pressing or welding, or by any other means suitable for connecting the halves.

The first side wall 21 has an outer first side wall surface 21*a* and an inner first side wall surface 21*b* (not seen in FIG. 1*a*) and the second side wall 22 has correspondingly an outer second side wall surface 22*a* and an inner second side wall surface 22*b* such that an interior space 10 of the hollow housing 2 is provided between the inner first side wall surface 21*b* and the inner second side wall surface 22*b*. The magazine 1 further comprises a stopping member 40 for preventing the follower 4 from escaping out from the hollow housing 2. The stopping member 40 is arranged to protrude from the inner first side wall surface 21*b* toward the interior space 10 of the hollow housing 2.

The stopping member 40 comprises a stopping surface 40*a* for contacting the follower 4, the stopping member 40 is arranged to the inner first side wall surface 21*b* such that the stopping surface 40*a* is at a first distance from the first upper end 21*c*. As seen from FIG. 1*a* the stopping member 40 is arranged in this embodiment of the invention to extend the first distance A from the feed opening 50 along the inner first side wall surface 21*b* toward the base of the hollow housing 2. The stopping member 40 comprises a stopping surface 40*a* forming a contact point for the follower 4 for stopping the movement of the follower 4. The stopping surface 40*a* is arranged at the first distance A from the feed opening 50. The stopping surface 40*a* is arranged such that it faces toward a projection arranged in the follower 4 for stopping the follower 4. The stopping surface 40*a* is preferably facing toward the base 11 of the hollow housing 2.

The magazine 1 further comprises a pair of feed lips 20 for single feeding the cartridges into the firearm, the pair of feed lips 20 is formed by a first feed lip 20*a* and a second feed lip 20*b* (not shown in FIG. 1*a*). The first feed lip 20*a* is arranged in connection with the first upper end 21*c* of the first side wall 21 of the hollow housing 2 and protruding from the first upper end 21*c* away from the first side wall 21 and the second feed lip 20*b* is arranged in connection with the second upper end 22*c* of the second side wall 22 of the hollow housing 2 and protruding from the second upper end 22*c* away from the second side wall 22.

The width of the interior space 10 of the hollow housing 2 substantially corresponds to the diameter of a cartridge with a tolerance such that the cartridges can be moved inside the hollow housing 2 with the help of the follower 4. The width is the distance between the first inner side wall surface 21*b* and the second inner side wall surface 22*b*.

The stopping member 40 is in the embodiment shown in FIG. 1*a* arranged to extend from the first feed lip 20*a* along the inner first side wall surface 21*b* such that as the first feed lip 20*a* is arranged to protrude from the first upper end 21*c* away from the hollow housing 2 and the stopping member 40 is arranged to extend from the first upper end 21*c* to the opposite direction, i.e. toward the base of the hollow housing 2. The stopping member 40 is arranged to protrude from the inner first side wall surface 21 toward the interior space 10 of the hollow housing 2 but the protrusion of the stopping member 40 also extends from the first upper end 21*c* to the stopping surface 40*a*. In this embodiment of the invention the stopping member 40 forms together with the first feed lip 20*a* an integral structure.

The hollow housing 2 is formed of the first side wall 21 and the opposing second side wall 22, a rear wall 23 and a front wall 24 opposing the rear wall 23, and a base 11 enclosing the hollow housing 2 in a lower end of the hollow housing 2. The first feed lip 20*a* has a length dimension that is parallel to the length dimension of the hollow housing 2 which is the dimension between the rear wall 23 and the front wall 24. The first feed lip 20*a* has also a height dimension that is the dimension from the first upper end 21*c* upward away from the hollow housing 2. The second feed lip 20*b* has the corresponding dimensions. The first feed lip 20*a* and the second feed lip 20*b* are arranged to extend only part of the length of the hollow housing 2, i.e. only part of the length of the first side wall 21 between the rear wall 23 and the front wall 24. The first feed lip 20*a* and the second feed lip 20*b* has a length that is between about 10-50% of the total length of the feed opening 50 between the rear wall 23 and the front wall 24 such that the feed lips 20 are configured to partially occlude the feed opening 50 of the hollow housing 2. The feed lips 20 extend along the first and second upper ends 21*c*, 22*c* and from the first and second upper ends 21*c*, 22*c* upwards. In still other words, the feed lips 20 extend only part of the length of the feed opening 50 where the feed opening 50 has the length defined between the rear wall 23 and the front wall 24. The length of the feed opening 50 is defined as the inner length, i.e. the length between the inner surface of the rear wall 23 and the inner surface of the front wall 24 both facing toward the interior space 10 of the hollow housing 2.

According to the invention the first feed lip 20*a* further extends from the first upper end 21*c* along the inner first side wall surface 21*b* or the first feed lip 20*a* further extends from the first upper end 21*c* along the inner first side wall surface 21*b* and the second lip 20*b* further extends from the second upper end 22*c* along the inner second side wall surface 22*b*. The first feed lip 20*a* comprises a lower end 201*a* and the first feed lip 20*a* extends from the first upper end 21*c* of the first side wall 21 to the lower end 201*a*, the lower end 201*a* is arranged at the first distance A from the first upper end 21*c* such that the lower end 201*a* is arranged to form the stopping surface 40*a*. Correspondingly, the second feed lip 20*b* comprises a lower end 201*b* and the second feed lip 20*b* extends from the second upper end 22*c* of the second side wall 22 to the lower end 201*b*, the lower end 201*b* is arranged at the first distance A from the second upper end 22*c* such that the lower end 201*b* is arranged to form a second stopping surface.

The stopping member 40 has a length that is only part of the length of the hollow housing 2 and such that the stopping member 40 is preferably arranged to the middle part of the hollow housing 2 in the length direction. The definition of length and the length direction in this context means the direction between the rear wall 23 and the front wall 24. The length of the stopping member 40 is preferably the same as the length of the feed lips 20 or smaller. Other lengths are also possible and the stopping member may converge or diverge toward the feed lips 20.

In other words, the hollow housing 2 has the first upper end 21*c* and the second upper end 22*c* and the first feed lip 20*a* is arranged to protrude from the first upper end 21*c* such that the protrusion of the first feed lip 20*a* covers the first upper end 21*c* only partly. Correspondingly, the second feed lip 20*b* is arranged to protrude from the second upper end 22*c* such that the protrusion of the second feed lip 20*b* covers the second upper end 22*c* only partly.

FIG. 1*a* also shows that the magazine 1 further comprises a spring 3 in connection with the follower 4 such that the spring is arranged to extend between the follower and the base 11 of the hollow housing 2. The spring 3 is arranged in contact with the bottom surface of the follower 4 and the spring 3 pushes the follower 4 upwards in the interior 10 of the hollow housing 2 such that the follower 4 is movable in the hollow housing 2.

The hollow housing 2 has an aperture in the first side wall 21. The aperture 60 is arranged to go through the first side wall 21 and arranged at a second distance B from the first upper end 21*c* such that at least part of the aperture 60 is arranged below the stopping member 40 in a height direction of the magazine 1. The height direction of the magazine 1 is the direction from the base 11 toward the feed opening 50. The aperture 60 is arranged such that when the projection 44 (shown in FIGS. 7 and 8) of the follower 4 is in contact with the stopping surface 40*a* of the stopping member 40 the projection is toward the aperture 60. The aperture 60 may also be arranged to go at least partly through the stopping member 40.

The stopping surface 40*a* is arranged at the first distance A from the first upper end 21*c* and the aperture 60 is arranged to go through the first side wall 21 at a second distance B from the first upper end 21*c*. The first distance A is equal or smaller than the second distance B. In other words, the second distance B is equal or greater than the first distance A. The second distance B is the distance between the upper end 21*c* and the middle point of the aperture 60, or the lower end of the aperture when the aperture 60 is not symmetrical. The distance B is preferably in a range between 3 mm and 10 mm, more preferably between 5 mm and 8 mm and most preferably between 6 mm and 7 mm.

The first distance A is provided such that when the follower 4 presses the last cartridge resting on the surface of the follower 4 against the feed lips 20 the projection 44 is not touching the stopping surface 40*a*, meaning that the first distance A is provided such that when the follower 4 presses the last cartridge against the feed lips 20 there is a gap between the projection 44 of the follower 4 and the stopping surface 40*a*. After the last cartridge is shot the follower moves upward and makes a contact with the stopping member 40.

FIG. 1*b* shows the magazine 1 shown in FIG. 1*a* as a cross-section view. The first side wall 21 of the hollow housing 2 has a first upper end 21*c* and the second side wall 22 of the hollow housing 2 has a second upper end 22*c*. The stopping member 40 comprises a stopping surface 40*a* for contacting the follower 4 and for stopping the movement of the follower 4 upward toward the feed opening 50. The stopping member 40 is arranged to the inner first side wall surface 21*b* such that the stopping surface 40*a* is at a first distance A away from the first upper end 21*c*. The follower 4 has a counter surface which contacts the stopping surface 40*a*.

Although the figures are not in actual scale it can be seen from FIG. 1*b* that there is a space provided between the feed lips 20 and the follower 4 when the follower 4 has stopped its movement when contacting the stopping surface 40*a* of the stopping member 40. The space is enough for the user of the firearm to tilt the follower 4 inside the hollow housing 2 and get the follower out from the hollow housing 2. Before tilting the follower 4 the user has to insert a pin or a corresponding tip into the aperture 60 or, as an alternative embodiment shown later, to push a pushing member 90 provided in the first side wall 21, for pushing a projection (shown later in the figures) in the follower 4 such that the projection bends or pulls into the follower 4 or some other way moves away from making a contact with the stopping surface 40*a* such that the follower is free to move upward in the hollow housing 2 and can be tilted to be removed through the feed opening 50. In other words, the follower 4 is released from the hollow housing 2 by pushing or pressing the projection 44 in the follower through the aperture 60 or through the pushing member 90 in the hollow housing 2. In other words, the hollow housing 2 comprising a pushing member 90 in the first side wall 21, the pushing member 90 is arranged at a second distance B from the first upper end 21*c* such that when the projection 44 of the follower 4 is in contact with the stopping surface 40*a* of the stopping member 40 the projection 44 is at least partly toward the pushing member 90.

FIG. 1*b* shows that the stopping member 40 is arranged to extend from the first feed lip 20*a* along the inner first side wall surface 21*b* such that as the first feed lip 20*a* is arranged to protrude from the first upper end 21*c* away from the hollow housing 2 and the stopping member 40 is arranged to extend from the first upper end 21*c* to the opposite direction, i.e. toward the base of the hollow housing 2. The stopping member 40 is arranged to protrude from the inner first side wall surface 21 toward the interior space 10 of the hollow housing 2 but the protrusion of the stopping member 40 also extends from the first upper end 21*c* to the stopping surface 40*a*. The stopping member 40 forms together with the first feed lip 20*a* an integral structure. However, the stopping surface 40*a* is separate from the first feed lip 20*a* such that the stopping surface 40*a* is a distance away from the first feed lip 20*a*. Although in the embodiment shown in FIG. 1*b* the stopping member 40 is arranged to extend from the first feed lip 20*a* along the inner first side wall surface 21*b* the stopping member 40 is still arranged to protrude from the inner first side wall surface toward the interior space 10 of the hollow housing 2 and form the stopping surface 40*a* which faces toward the base 11. The stopping surface 40*a* is at least a length, which is the length of the stopping member 40 in the direction from the feed opening toward the base, from the first feed lip 20*a*. FIG. 1*c* shows the corresponding features as shown in FIG. 1*b* but FIG. 1*c* also shows that there is a second stopping member 401 arranged to extend from the second feed lip 20*b* along the inner second side wall surface 22*b* such that the second feed lip 20*b* is arranged to protrude from the second upper end 22*c* away from the hollow housing 2 and the second stopping member 401 is arranged to extend from the second upper end 22*c* to the opposite direction, i.e. toward the base of the hollow housing 2. The second stopping member 401 comprises a corresponding second stopping surface 401*a* as the stopping member 40. The second stopping member 401 is arranged to protrude from the inner second side wall surface 22 toward the interior space 10 of the hollow housing 2 but the protrusion of the second stopping member 401 also extends from the second upper end 22*c* to the second stopping surface 401*a*. The second stopping member 401 forms together with the second feed lip 20*b* an integral structure. Similarly, as in FIG. 1*b* the second stopping surface 401*a* is separate from the second feed lip 20*b* such that the stopping surface 401*a* is a distance away from the second feed lip 20*b*. Although in the embodiment shown in FIG. 1*c* the stopping member 401 is arranged to extend from the second feed lip 20*b* along the inner second side wall surface 22 the stopping member 401 is still arranged to protrude from the inner second side wall surface toward the interior space 10 of the hollow housing 2 and forms the stopping surface 401*a* which faces toward the base 11. The stopping surface 401*a* is at least a length, which is the length of the stopping member 401 in the direction from the feed opening toward the base, from the second feed lip 20*b*.

The second stopping member 401 is arranged to make contact with the follower 4 only when the follower 4 is arranged to have a second projection protruding from the second side surface 41 of the follower 4 correspondingly as the projection 44 as explained later. When the follower 4 has projections on both side surfaces then the second side wall 22 then the second side wall 22 comprises also corresponding aperture 60 as the first side wall 21 or a corresponding pushing member 90 as the first side wall 21.

Figures 2A, 2B, 2C:
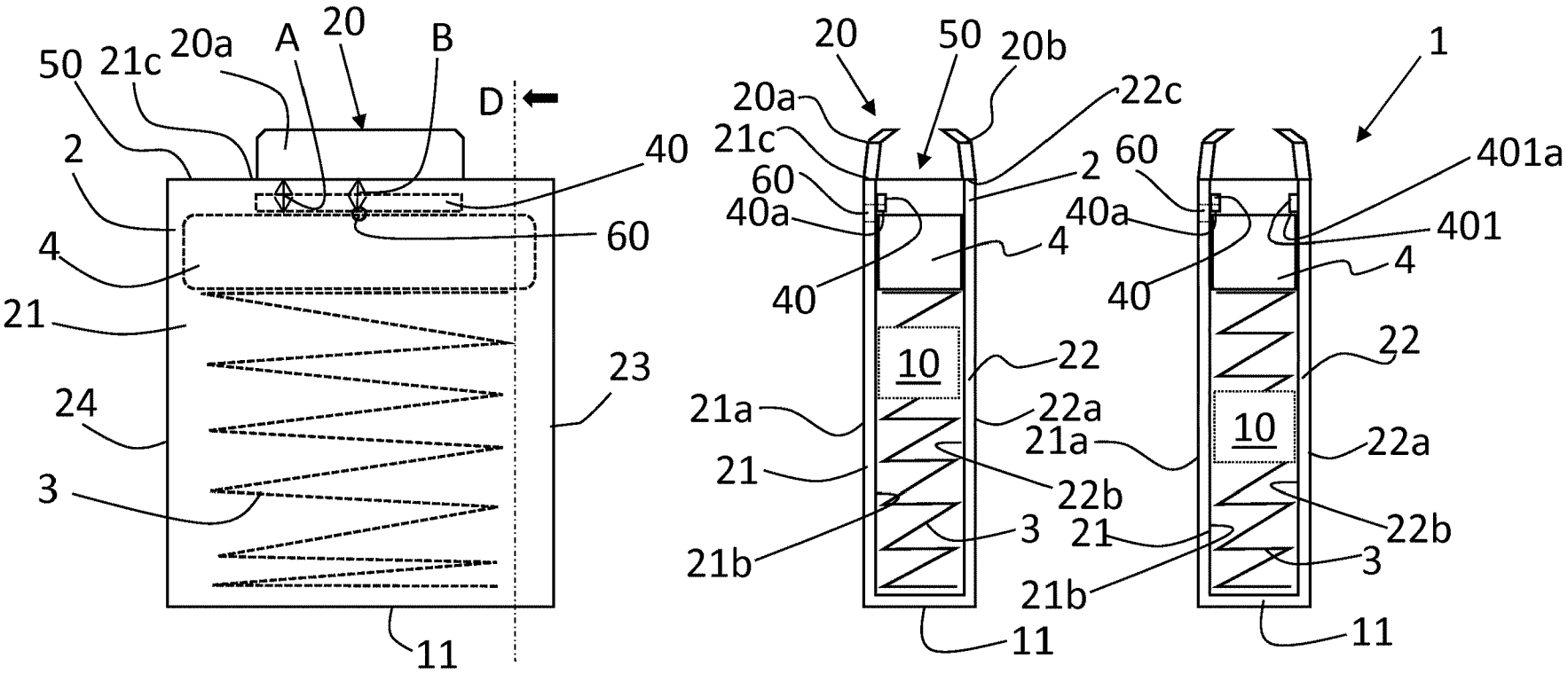
FIG. 2*a* shows another magazine according to the invention.
FIG. 2*b* shows a cross-section of a magazine along the line D shown in FIG. 2*a;*
FIG. 2*c* shows a cross-section of another embodiment of a magazine along the line D shown in FIG. 2*a;*

FIG. 2*a* shows another embodiment of the magazine 1 according to the invention in which all the other features are similar to those expressed in connection with FIG. 1*a* except the stopping member 40. The stopping member 40 in this embodiment of the invention is arranged to protrude from the inner first side wall surface 21*b* toward the interior space 10 of the hollow housing 2 similarly as in FIG. 1*a* but with the difference that the stopping member 40 is not arranged to extend from the first upper end 21*c* along the first inner side wall surface 21*b* but the stopping member 40 is arranged to protrude from the first inner side wall surface 21*b* in a point which is at a distance from the first upper end 21*c*. The stopping member 40 comprises a stopping surface 40*a* for contacting the follower 4 and the stopping member 40 is arranged to the inner first side wall surface 21*b* such that the stopping surface 40*a* is at a first distance A away from the first upper end 21*c*.

In this embodiment of the invention the stopping member 40 is arranged to extend only part of the length of the hollow housing 2 but the stopping member 40 can be also another kind of a stopper such as a single peg-like stopper or it can be a plurality of peg-like stoppers in a row. The stopping member 40 has a stopping surface 40*a* which faces toward the base 11 of the hollow housing 2 wherefrom the follower 4 is arranged to move toward the stopping member 40 with the help of the spring 3. An aperture 60 is arranged similarly as explained in connection with FIG. 1*a* such that at least part of the follower 4 is facing toward the aperture 60 when contacting the stopping surface 40*a* of the stopping member 40.

FIG. 2*b* shows the magazine shown in FIG. 2*a* as a cross-section view. As can be seen from the figure the stopping member 40 is arranged to protrude from the inner first side wall surface 21*b* toward the interior space 10 of the hollow housing 2 and the stopping member 40 comprises a stopping surface 40*a* for stopping the movement of the follower 4.

FIG. 2*c* shows that there is a second stopping member 401 as explained in connection with FIG. 1*c* but as explained in connection with FIG. 2*a* the second stopping member 401 is arranged to protrude from the inner second side wall surface 22*b* toward the interior space 10 of the hollow housing 2 but not extending from the second upper end 22*c* along the inner second side wall surface 22*b*. The second stopping member 401 is arranged to protrude from the inner second side wall surface 22*b* in a point which is at a distance from the second upper end 22*c*. The second stopping member 401 comprises a stopping surface for contacting the follower 4 and the second stopping member 401 is arranged to the inner second side wall surface 22*b* such that the stopping surface is at a first distance A away from the second upper end 22*c*.

Figure 3:
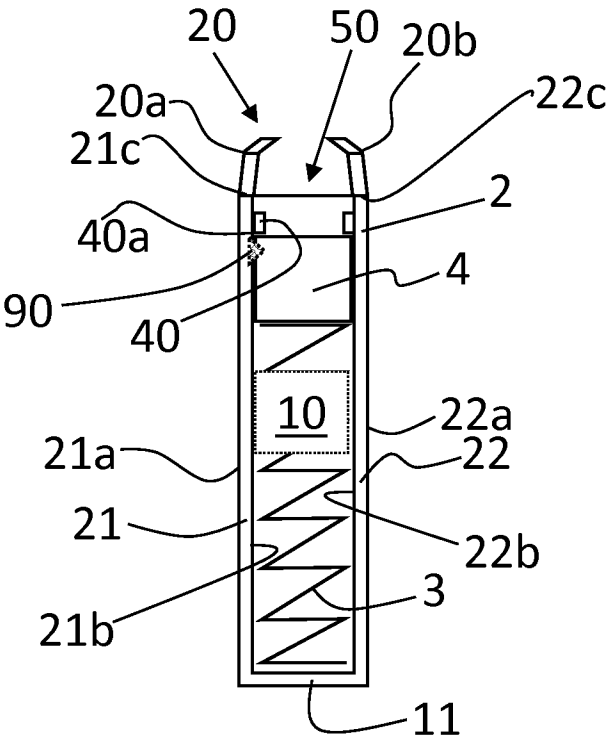
FIG. 3 shows still another magazine according to the invention.

FIG. 3 shows still another embodiment of a magazine 1 according to the invention in which the hollow housing 2 comprises a pushing member 90 in the first side wall 21, the pushing member 90 is arranged at the second distance B from the first upper end 21*c* such that when the projection 44 of the follower 4 is in contact with the stopping surface 40*a* of the stopping member 40 the projection 44 is at least partly toward the pushing member 90. The pushing member 90 is arranged such that by bending the first side wall 21 or by pressing or pushing it the pushing member 90 pushes the projection 44 in the follower such that the projection 44 bends or moves inwards to the follower 4 for allowing the follower 4 to move past the stopping member 40. The stopping surface 40*a* is arranged at the first distance A from the first upper end 21*c* and the pushing member 90 is arranged at the second distance B from the first upper end 21*c* which the distance B from the first upper end 21*c* is greater than the distance A.

Figure 4:
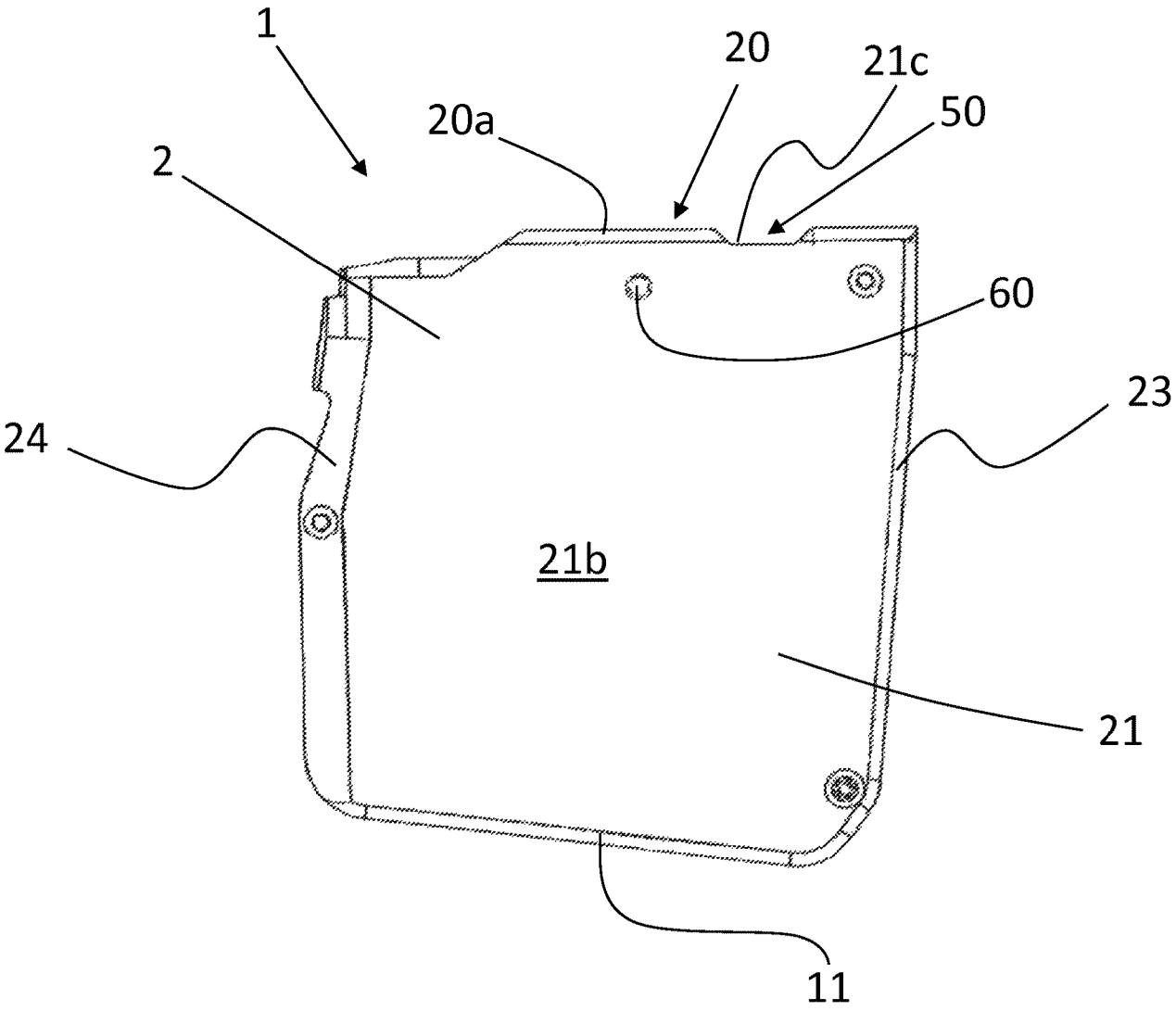
FIG. 4 shows exterior of a magazine according to the invention.

FIG. 4 shows an exterior of a magazine 1 according to the invention. The first feed lip 20*a* is arranged to protrude from the first upper end 21*c* and the second feed lip 20*b* protrudes similarly from the second upper end 22*c* on the opposite side and therefore cannot be seen in this figure which shows only the first side wall 21. As can be seen from the FIG. 4 the first feed lip 20*a* extends in the length direction of the magazine 1 (i.e. the direction from the rear wall 23 of the hollow housing 2 to the front wall 24 of the hollow housing 2) only part of the length of the first upper end 21*c*. The first upper end 21*c* is the surrounding end of the first side wall 21 wherefrom the first feed lip 20*a* is arranged to protrude upwards. The second upper end 22*c* is similarly the surrounding the end of the second side wall 22 wherefrom the second feed lip 20*b* is arranged to protrude upwards.

Figure 5:
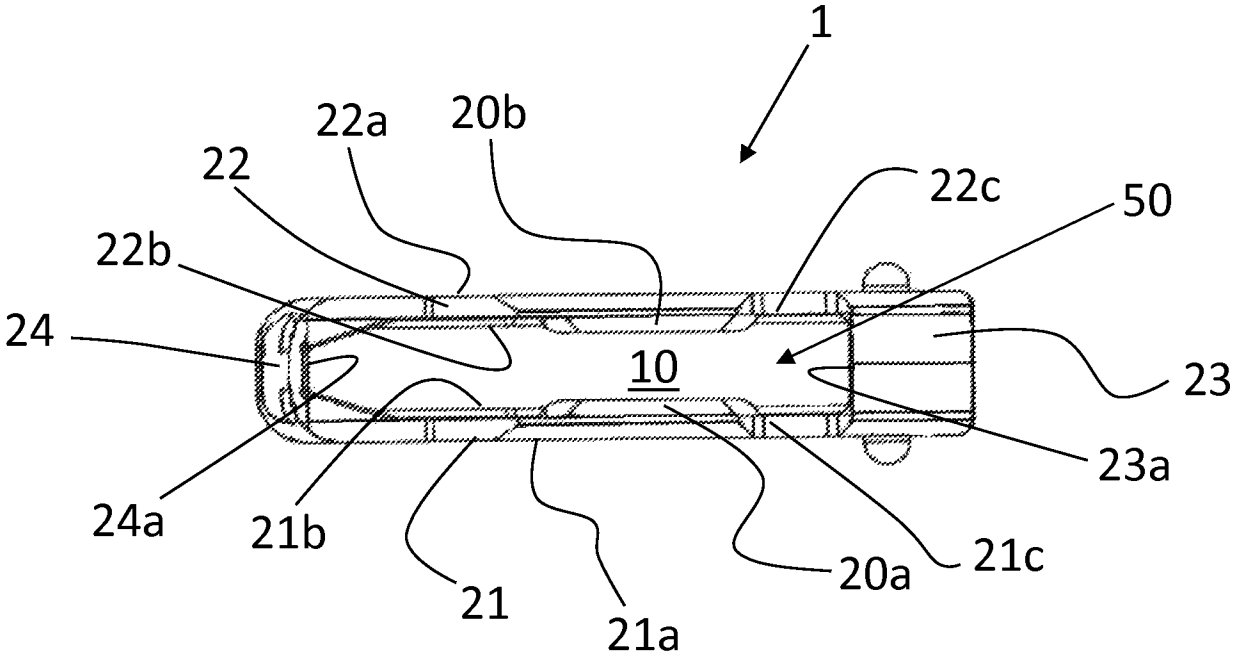
FIG. 5 shows a magazine as seen from above.

FIG. 5 shows a magazine 1 as seen from above, in which the first feed lip 20*a* is arranged to protrude from the first upper end 21*c* of the first side wall 21 and the second feed lip 20*b* is arranged to protrude from the second upper end 22*c* of the second side wall 22. As can be seen from the figure the feed lips 20, i.e. the first feed lip 20*a* and the second feed lip 20*b* protrude from the side walls 21, 22 upward and slightly inward toward each other. The feed opening 50 as can be seen from this figure the first feed lip 20*a* and the second feed lib 20*b* extend only part of the length of the feed opening 50 where the feed opening 50 has the length defined between the rear wall 23 and the front wall 24. As already said the length of the feed opening 50 is defined as the inner length, i.e. the length between the inner surface of the rear wall 23, i.e. a rear inner surface 23*a*, and the inner surface of the front wall 24, i.e. a front inner surface, both facing toward the interior space 10 of the hollow housing 2.

Figure 6:
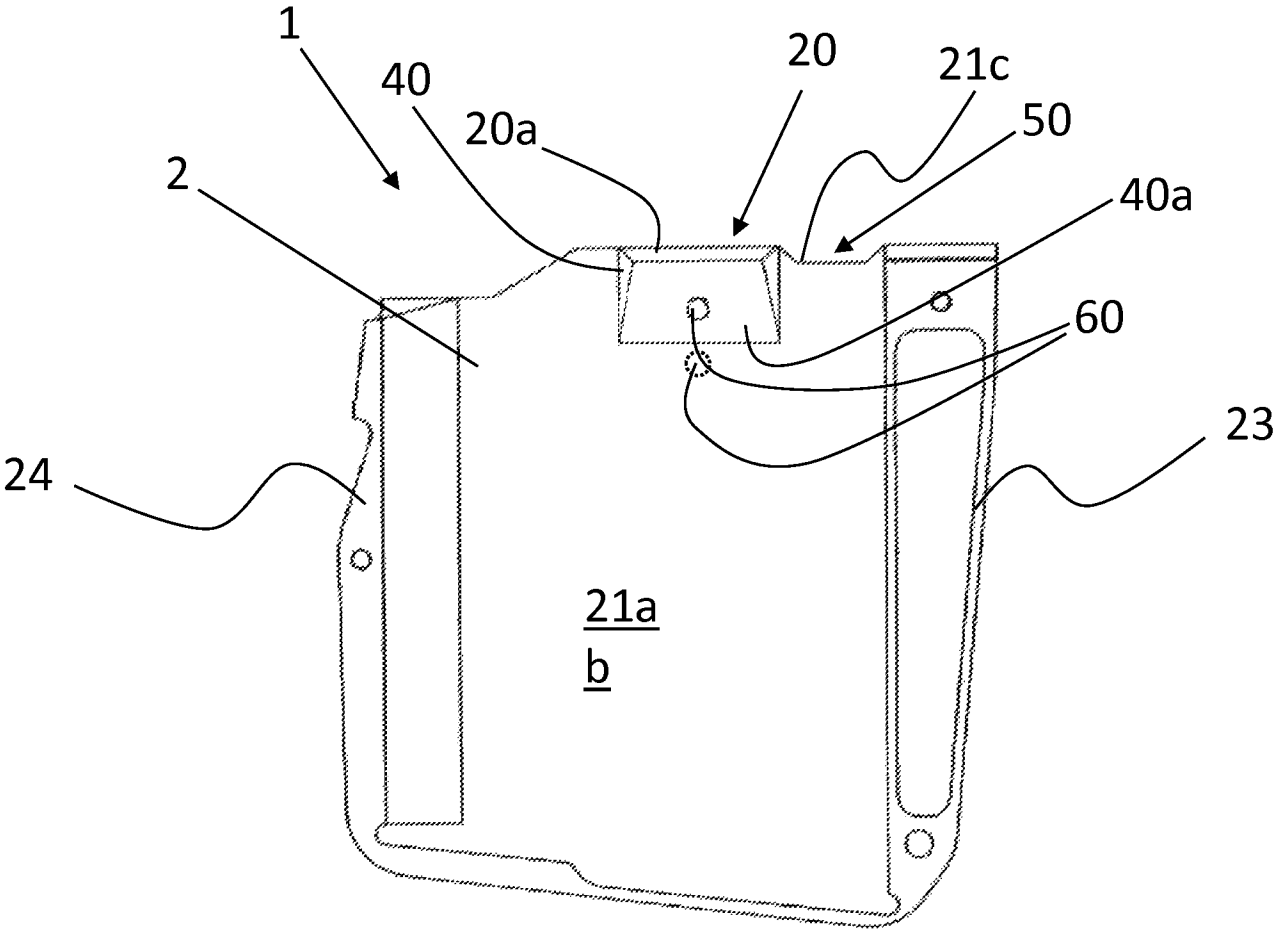
FIG. 6 shows interior of a magazine according to the invention.

FIG. 6 shows an interior of a magazine 1 according to an embodiment of the invention in which the inner first side wall surface 21*b* comprises an aperture 60 that is arranged to go through the first side wall 21 and is provided preferably under the stopping member 40 (shown as a dashed line) or at least partly under the stopping member 40 or in the stopping member 40 such that the aperture is arranged to go through the stopping surface 40*a* (shown as a solid line) such that when the upward movement of the follower 4 is stopped because of contacting the stopping surface 40*a* of the stopping member 40 a projection of the follower 4 is toward the aperture 60.

The stopping member 40 when being integral with the first feed lip 20*a* is preferably arranged to protrude from the inner first side wall surface 21*b* such that the thickness of the stopping member 40 increases towards the feed opening 50 such that the interior space 10 or the distance between the stopping member 40 and the opposite inner second side wall surface 22*b* or the interior space 10 or the distance between the stopping member 40 and the second stopping member decreases. When the thickness of the stopping member 40 increases toward the feed opening 50 the stopping surface 40*a* may also be formed as an inclined surface in the stopping member 40.

Figure 7:
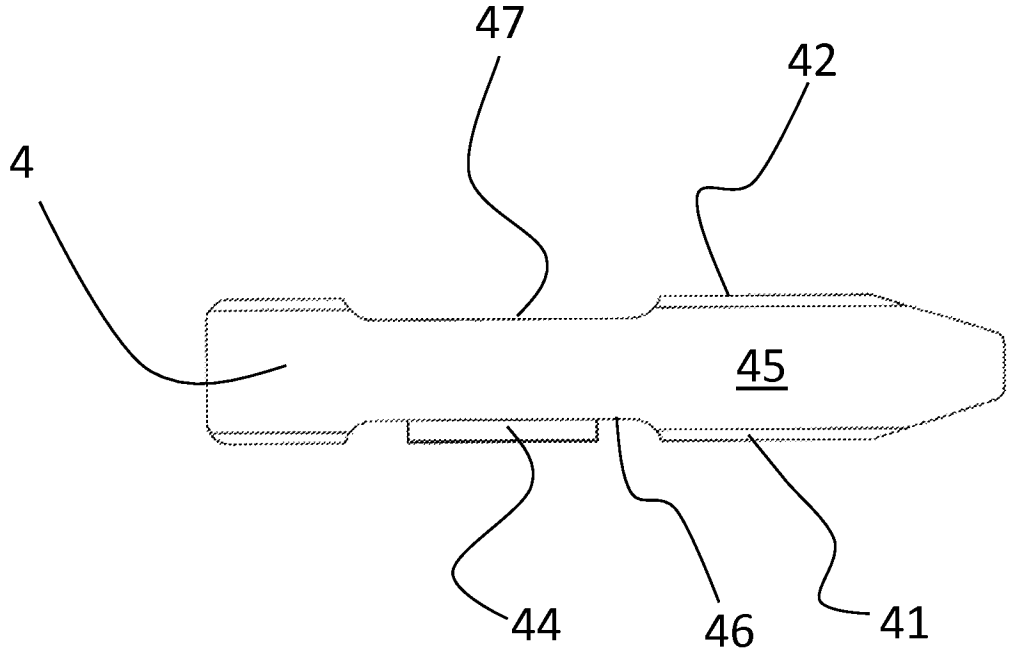
FIG. 7 shows a follower as seen from top.

FIG. 7 shows a follower 4 as seen from top. The follower 4 has a top surface 45 for supporting a cartridge, a first side surface 41 facing toward the inner first side wall surface 21*b* of the hollow housing 2 and a second side surface 42 facing toward the inner second side wall surface 22*b* of the hollow housing 2. The follower 4 further has a projection 44 for forming a contact point with the stopping surface 40*a* of the stopping member 40 of the hollow housing 2. The follower 4 has preferably an outer form that corresponds the form of the interior space 10 of the hollow housing 2. In the embodiment shown in FIGS. 6 and 7 the projection 44 is arranged to protrude from the first side surface 41 of the follower 4. In another embodiment of the invention the projection is arranged to protrude from the top surface 45 of the follower 4. The projection 44 can be a tongue or a pin or other form of a protrusion that can make a contact with the stopping surface 40*a* of the stopping member 40. The projection 44 is a flexible member or the projection 44 is arranged to be flexible, bendable or a spring member such that when it is pressed it bends inwards so that the follower 4 can bypass the stopping member 4 in the hollow housing 2.

The follower 4 preferably comprises a narrowing 46 in the first side surface 41. The projection 44 is preferably arranged in the narrowing 46. The follower 4 may also comprise another narrowing 47 on the opposite side of the follower in the second side surface 42. The projection 44 is preferably arranged in the narrowing 46 such that the projection 44 is arranged to extend from the bottom of the narrowing 46 to the same level as the rest of the first side surface 41. The narrowing 46, 47 can be a recess or other similar form. In a preferred embodiment of the invention the follower 4 comprises a first narrowing 46 in the first side surface 41 and a second narrowing 47 in the second side surface 42. The first and second narrowing 46, 47 are arranged such that the length of the narrowing corresponds the length of the feed lips 20.

Figure 8:
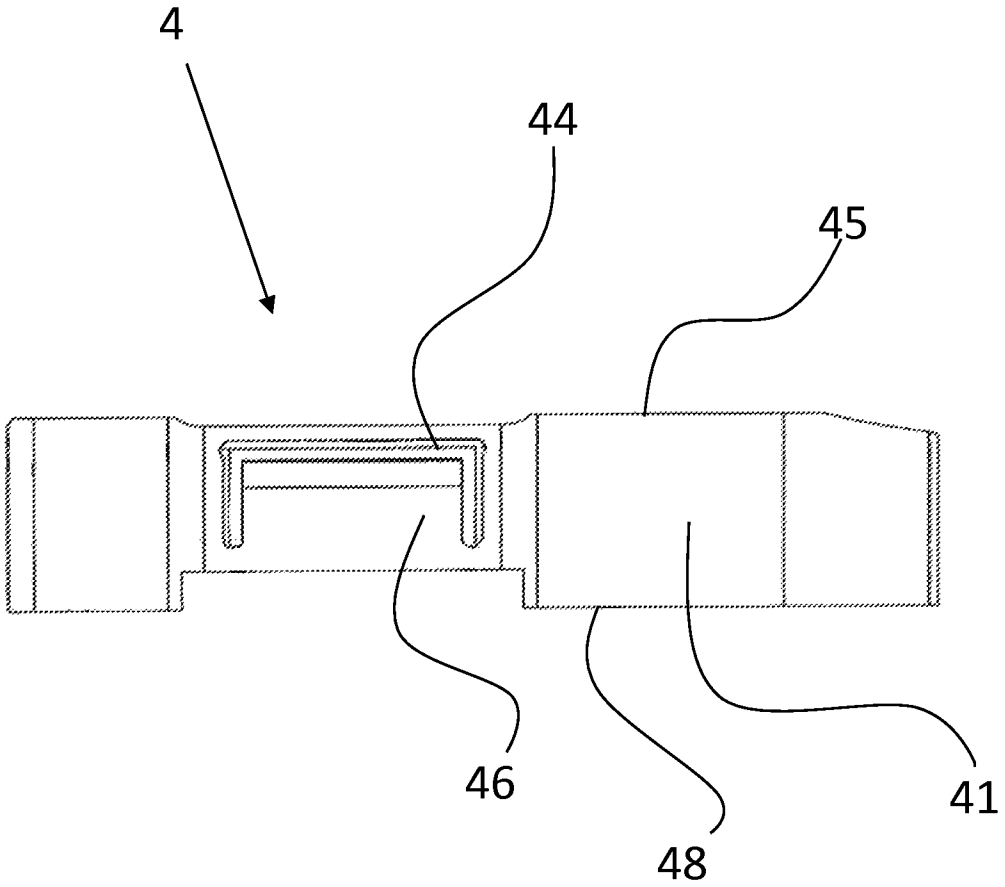
FIG. 8 shows a follower as seen from side.

FIG. 8 shows a follower 4 as seen from side. The follower 4 has a top surface 45, a bottom surface 48, a first side surface 41 and a second side surface (not shown in this figure). The first side surface 41 comprises a narrowing 46 in which a projection 44 is arranged. The projection 44 is arranged to protrude from the narrowing 46 outwards to the same level as the first side surface 41 outside the narrowing 46. The projection 44 may extend in an angle upwards from the first side surface 41 of the follower. In other words, upwards and towards the inner first side surface 21*b* of the hollow housing 2. As earlier indicated the follower 4 has a counter surface in the projection 44 which contacts the stopping surface 40*a*. The counter surface is facing upwards such that it contacts the stopping surface 40*a* of the stopping member 40.

The follower 4 may comprise a projection 44 on both sides of the follower 4 and the hollow housing 2 may also comprise a stopping member 40 on both inner surfaces 21*b*, 22*b* and therefore both side walls 21, 22 also may comprise apertures 60 or pushing members 90. The hollow housing 2 and the follower 4 may be symmetrical along the length direction, the length direction means the direction between the rear wall 23 and the front wall 24. When the hollow housing is symmetrical then the features explained in connection with the first side wall 21 also apply to the second side wall 22. However, when the hollow housing 2 is symmetrical then the follower 4 does not need to be symmetrical when it comes to the projection 44. The projection 44 can be arranged only one side of the follower.

The hollow housing 2 is preferably made of metal such as aluminium alloy, or plastic. The follower 4 is preferably made of plastic and most preferably of Delrin® acetal, Polyoxymethylene POM. The follower 4 may in other embodiments of the invention be made of metal.

The feed lips 20 that extend along the inner side wall surfaces 21*b*, 22*b* of the hollow housing 2 and preferably such that at least the first feed lip 20*a* forms an integral structure with the stopping member 40 enable shortening the upward projecting part of the feed lips 20 without compromising the operation of the magazine 1. The narrowings of the follower 4 enable the follower 4 to move appropriately inside the hollow housing 2 when the feed lips extend along the inner side wall surfaces. The projection of the follower 4 keeps the follower 4 appropriately inside the hollow housing 2 when there is no need to remove the follower 4. The short length of the feed lips 20 extending between the front wall and the rear wall of the hollow housing 2 together with the stopping member 40 enable easy tilting and removing of the follower from the hollow housing 2.

The invention has been described above with reference to the examples shown in the figures. However, the invention is in no way restricted to the above examples but may vary within the scope of the claims.

The invention claimed is:

1. A magazine for a firearm, the magazine comprising:

a hollow housing for retaining a plurality of cartridges;

a follower arranged inside the hollow housing, the hollow housing comprising a first side wall, a second side wall opposing the first side wall and a feed opening for feeding the cartridges into the firearm, the first side wall comprising an outer first side wall surface and an inner first side wall surface and the second side wall comprising an outer second side wall surface and an inner second side wall surface such that an interior space of the hollow housing is provided between the inner first side wall surface and the inner second side wall surface, wherein the follower includes a top surface for supporting a cartridge, a first side surface facing toward the inner first side wall surface of the hollow housing and a second side surface facing toward the inner second side wall surface of the hollow housing; and a stopping member for preventing the follower from escaping out from the hollow housing, said stopping member is arranged to protrude from the inner first side wall surface toward the interior space of the hollow housing, the first side wall of the hollow housing comprising a first upper end and the second side wall of the hollow housing comprising a second upper end, the stopping member comprises a stopping surface for contacting the follower, the stopping member is arranged on the inner first side wall surface such that the stopping surface is at a first distance from the first upper end, wherein the follower further includes a projection for forming a contact point with the stopping surface on the stopping member, wherein the first side surface of the follower is arranged to have a narrowing and said projection is arranged in the narrowing.

2. The magazine according to claim 1, wherein the magazine further comprises:

a pair of feed lips for single feeding the cartridges into the firearm, the pair of feed lips is formed by a first feed lip and a second feed lip, the first feed lip is arranged in connection with the first upper end of the first side wall and protruding from the first upper end away from the first side wall and the second feed lip is arranged in connection with the second upper end of the second side wall and protruding from the second upper end away from the second side wall.

3. The magazine according to claim 2, wherein the first feed lip further extends from the first upper end along the inner first side wall surface.

4. The magazine according to claim 3, wherein the first feed lip comprises a lower end and the first feed lip extends from the first upper end of the first side wall to the lower end, the lower end is arranged at the first distance from the first upper end such that the lower end is arranged to form the stopping surface.

5. The magazine according to claim 1, wherein the projection is arranged to protrude from the first side surface of the follower.

6. The magazine according to claim 1, wherein the projection is flexible.

7. The magazine according to claim 1, wherein the projection is a tongue or a pin.

8. The magazine according to claim 1, wherein the hollow housing comprising an aperture in the first side wall, the aperture is arranged to go through the first side wall at a second distance from the first upper end of the first side wall such that when the projection of the follower is in contact with the stopping surface of the stopping member the projection is at least partly toward the aperture.

9. The magazine according to claim 1, wherein the hollow housing comprises a pushing member in the first side wall, the pushing member is arranged at a second distance from the first upper end such that when the projection of the follower is in contact with the stopping surface of the stopping member the projection is at least partly toward the pushing member.

10. The magazine according to claim 8, wherein the second distance from the first upper end is equal to the first distance from the first upper end.

11. The magazine according to claim 1, wherein the magazine further comprises a spring in connection with the follower such that the spring is arranged to extend between the follower and a base of the hollow housing for pushing the follower upward in the hollow housing.

12. The magazine according to claim 1, wherein the hollow housing is made of metal.

13. The magazine according to claim 1, wherein the hollow housing is made of aluminium alloy.

14. The magazine according to claim 3, wherein the second lip further extends from the second upper end along the inner second side wall surface.

15. The magazine according to claim 1, wherein the projection is arranged to protrude from the top surface of the follower.

16. The magazine according to claim 1, wherein the projection is a spring member.

17. The magazine according to claim 1, wherein the second distance from the first upper end is greater than the first distance from the first upper end.

18. The magazine according to claim 1, wherein the projection is configured to move inwardly toward the first side surface of the follower.

19. The magazine according to claim 2, wherein the narrowing has a length corresponding to a length of the first feed lip.

20. The magazine according to claim 19, wherein the first feed lip is in overlapping alignment with the narrowing such that the first feed lip passes through the narrowing as the follower is removed from the hollow housing via the feed opening.

* * * * *